US008157070B2

(12) United States Patent
Okanishi et al.

(10) Patent No.: US 8,157,070 B2
(45) Date of Patent: Apr. 17, 2012

(54) MARINE REDUCTION AND REVERSE GEAR UNIT

(75) Inventors: Toshiaki Okanishi, Amagasaki (JP); Kazuyoshi Harada, Amagasaki (JP)

(73) Assignee: Yanmar Co., Ltd., Osaka (JP)

( * ) Notice: Subject to any disclaimer, the term of this patent is extended or adjusted under 35 U.S.C. 154(b) by 1058 days.

(21) Appl. No.: 11/878,322

(22) Filed: Jul. 24, 2007

(65) Prior Publication Data

US 2008/0026652 A1 Jan. 31, 2008

(30) Foreign Application Priority Data

Jul. 25, 2006 (JP) ..... 2006-201714

(51) Int. Cl.
*F16D 25/0638* (2006.01)

(52) U.S. Cl. ..... 192/51; 192/48.619; 440/75

(58) Field of Classification Search ..... 440/75
See application file for complete search history.

(56) References Cited

U.S. PATENT DOCUMENTS

| | | | | |
|---|---|---|---|---|
| 3,695,401 | A * | 10/1972 | Nagasaki | 192/21 |
| 3,922,997 | A * | 12/1975 | Jameson | 440/75 |
| 4,383,829 | A | 5/1983 | Allen, Jr. et al. | |
| 4,568,289 | A * | 2/1986 | Heidrich et al. | 440/3 |
| 4,735,104 | A * | 4/1988 | Giurati et al. | 74/417 |
| 6,443,286 | B1 | 9/2002 | Bratel et al. | |
| 6,761,600 | B2 * | 7/2004 | Daus et al. | 440/75 |
| 2006/0157316 | A1 * | 7/2006 | Okanishi et al. | 192/221 |

FOREIGN PATENT DOCUMENTS

| | | |
|---|---|---|
| JP | A-62-242162 | 10/1987 |
| JP | U-06-40560 | 5/1994 |
| JP | A-06-65904 | 8/1994 |
| JP | A-2006-117160 | 5/2006 |

* cited by examiner

*Primary Examiner* — David D Le
*Assistant Examiner* — Ryan Dodd
(74) *Attorney, Agent, or Firm* — Posz Law Group, PLC

(57) ABSTRACT

A marine reduction and reverse gear unit having an output shaft disposed at an acute (or obtuse) angle with respect to an input shaft 7 comprises: a drive gear 15 for transmitting torque from the input shaft 7; first and second driven gears 30, 31 engaged with the drive gear and disposed on the right and left sides thereof to sandwich the drive gear between the first and second driven gears; a reverse gear 16 connected to the drive gear 15 via a reverse hydraulic clutch 16; a first forward speed gear 33 connected to the first driven gear 30 via a hydraulic clutch; a second forward speed gear connected to the second driven gear 31 via a hydraulic clutch; and an output gear 26 fixed on the output shaft and engaged directly with one of the reverse gear 16, first forward speed gear 33 and second forward speed gear 36, or engaged therewith via idle gears to thereby receive the transmitted torque. This marine reduction and reverse gear unit provides a stable boat speed and enhanced acceleration performance by increasing the number of engine revolutions when wakeboarding.

7 Claims, 13 Drawing Sheets

MARINE REDUCTION AND REVERSE GEAR UNIT

BACKGROUND OF THE INVENTION

1. Field of the Invention

The present invention relates to a marine reduction and reverse gear unit, and particularly to a marine reduction and reverse gear unit suitable for wakeboats.

2. Description of the Related Art

"V-drive" reduction and reverse gear units, which have an output shaft disposed at an acute angle with respect to an input shaft from an engine, are known (for example, Japanese Unexamined Patent Publication No. 2006-117160, Japanese Examined Patent Publication No. 1994-65904, Japanese Utility Model Publication No. 1994-40560, and U.S. Pat. No. 4,383,829). "Angle-drive" reduction and reverse gear units, which have an output shaft disposed at an obtuse angle with respect to an input shaft, are also known (for example, FIG. 4 of Japanese Examined Patent Publication No. 1994-65904, and U.S. Pat. No. 6,443,286).

In V-drive reduction and reverse gear units, the engine is mounted approximately horizontally on the aft side of the reduction and reverse gear unit. By disposing the entire drive system in one place toward the stern to save space, inboard space can be increased. In angle-drive reduction and reverse gear units, the engine is disposed slightly toward the center from the stern, but is mounted horizontally near the bottom of the boat, whereby inboard space can be increased. Therefore, both types of reduction and reverse gear units are widely used for middle and small marine vessels, such as pleasure boats.

Pleasure boats provided with such reduction and reverse gear units include motorboats called "wakeboats" designed especially for wakeboarding.

Wakeboats usually have a speed range of 0 to 45 mph (miles per hour). When used for wakeboarding, wakeboats run at about 20 mph with added ballast water, while intentionally creating a wake.

To achieve a boat speed of 20 mph, even an engine with a maximum speed of 5000 rpm rotates at about 2200 rpm. The number of gasoline engine revolutions to produce maximum torque is usually at least 3600 rpm, and an engine rotating at about 2200 rpm is likely to produce insufficient torque.

BRIEF SUMMARY OF THE INVENTION

The present invention provides a marine reduction and reverse gear unit which increases the number of engine revolutions when wakeboarding to thereby provide a stable boat speed and enhanced acceleration performance.

A first embodiment of a marine reduction and reverse gear unit according to the present invention, which has an output shaft disposed at an acute or obtuse angle with respect to an input shaft, comprises: a drive gear for transmitting torque from the input shaft; first and second driven gears engaged with the drive gear and disposed on the right and left sides of the drive gear to sandwich the drive gear therebetween; a reverse gear connected to the drive gear via a reverse hydraulic clutch; a first forward speed gear connected to the first driven gear via a first forward speed hydraulic clutch; a second forward speed gear connected to the second driven gear via a second forward speed hydraulic clutch; and an output gear fixed on the output shaft and engaged directly with any one of the reverse gear, first forward speed gear and second forward speed gear or engaged therewith via idle gears to thereby receive the transmitted torque.

In a second embodiment, the first embodiment is modified so that the drive gear is fixed on the input shaft; the reverse gear is rotatably supported by the input shaft; the first driven gear and the first forward speed gear are supported by a first support shaft, and the second driven gear and the second forward speed gear are supported by a second support shaft.

In a third embodiment, the first embodiment is modified so that the input shaft has a bevel gear fixed thereon; the drive gear or a gear for transmitting torque to the drive gear is engaged with the bevel gear to transmit torque from the input shaft to the drive gear; the drive gear and the reverse gear are supported by a third shaft; the first driven gear and the first forward speed gear are supported by a first support shaft; and the second driven gear and the second forward speed gear are supported by a second support shaft.

In a fourth embodiment, one of the first to third embodiments is modified so that the marine reduction and reverse gear unit further comprises a hydraulic circuit for controlling the hydraulic pressure of the reverse hydraulic clutch, first forward speed hydraulic clutch, and second forward speed hydraulic clutch; the hydraulic circuit comprises a shift control valve for switching oil passages to supply hydraulic oil to the first forward speed hydraulic clutch or to the second forward speed hydraulic clutch; and the shift control valve is a pilot-operated spring-return directional control valve using the primary hydraulic pressure as pilot pressure and configured to switch from an oil passage for supplying hydraulic oil to the second forward speed hydraulic clutch to an oil passage for supplying hydraulic oil to the first forward speed hydraulic clutch, based on the increase of hydraulic pressure.

In a fifth preferable embodiment, the fourth embodiment is modified so that the shift control valve is a 3-position directional control valve configured in such a manner when the valve is in the center position, the secondary port communicates with both of the oil passages for supplying hydraulic oil to the first forward speed hydraulic clutch and the second forward speed hydraulic clutch.

In a sixth preferable embodiment, the fourth and fifth embodiment is modified so that the pilot oil passage of the shift control valve is provided with a variable throttle or a variable flow-control valve.

In a seventh embodiment, one of the fourth to sixth embodiments is modified so that the return spring of the shift control valve is provided with a spring force adjustment mechanism.

The marine reduction and reverse gear unit according to the present invention is configured to shift the hydraulic clutches to transmit torque from the input shaft to the output shaft via one of the reverse gear, first forward speed gear, and second forward speed gear. Therefore, when wakeboarding, a first forward speed hydraulic clutch for a first forward speed gear for high reduction ratios is engaged to increase the number of engine revolutions, whereby a stable boat speed and enhanced acceleration performance can be provided.

DETAILED DESCRIPTION OF THE INVENTION

Figure 1:
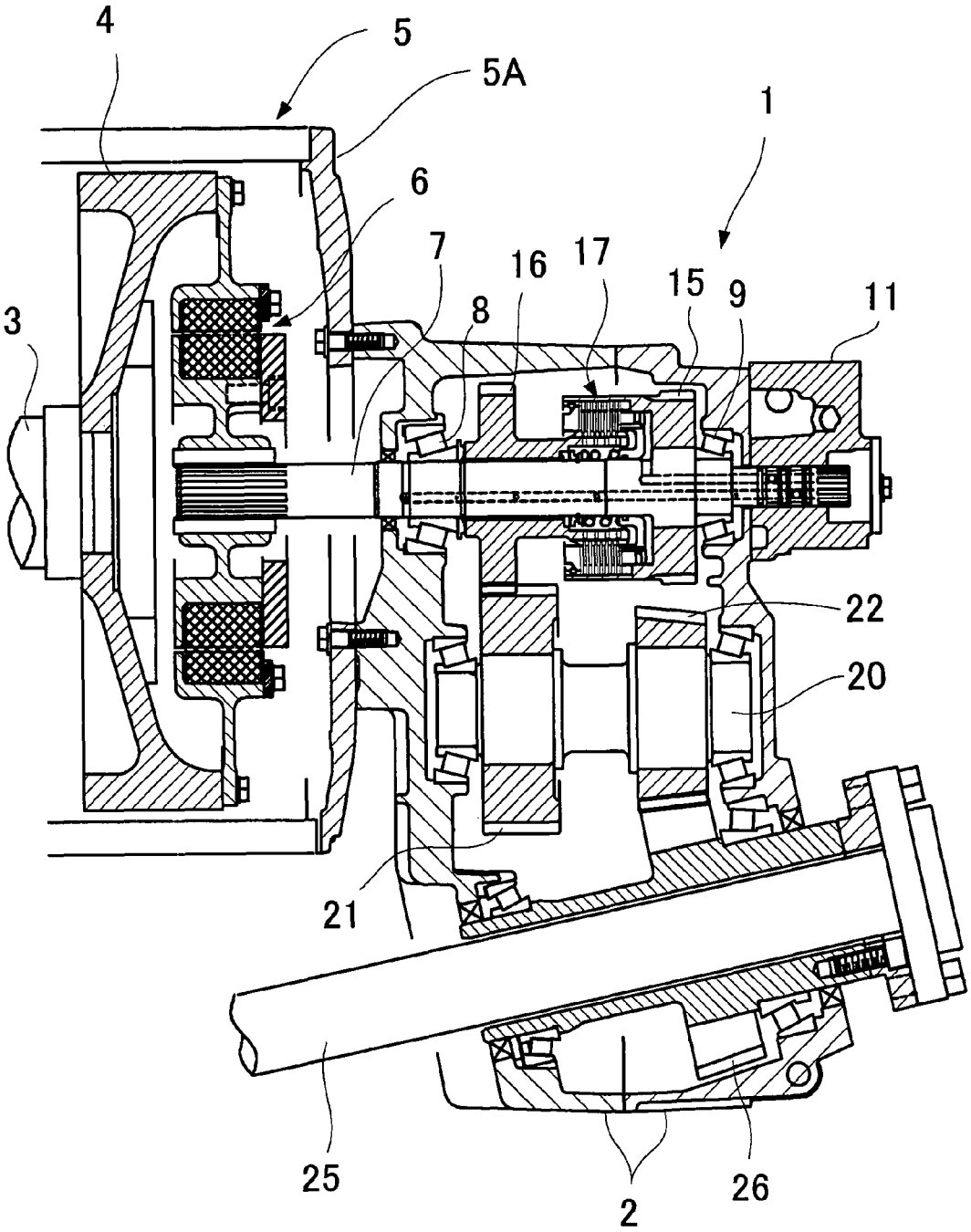
FIG. 1 is a longitudinal sectional view illustrating a first embodiment of a marine reduction and reverse gear unit according to the present invention.

Embodiments of marine reduction and reverse gear units according to the present invention are described below with reference to the attached drawings. In all of the drawings, the same reference numerals denote the same constitutional elements.

Figure 2:
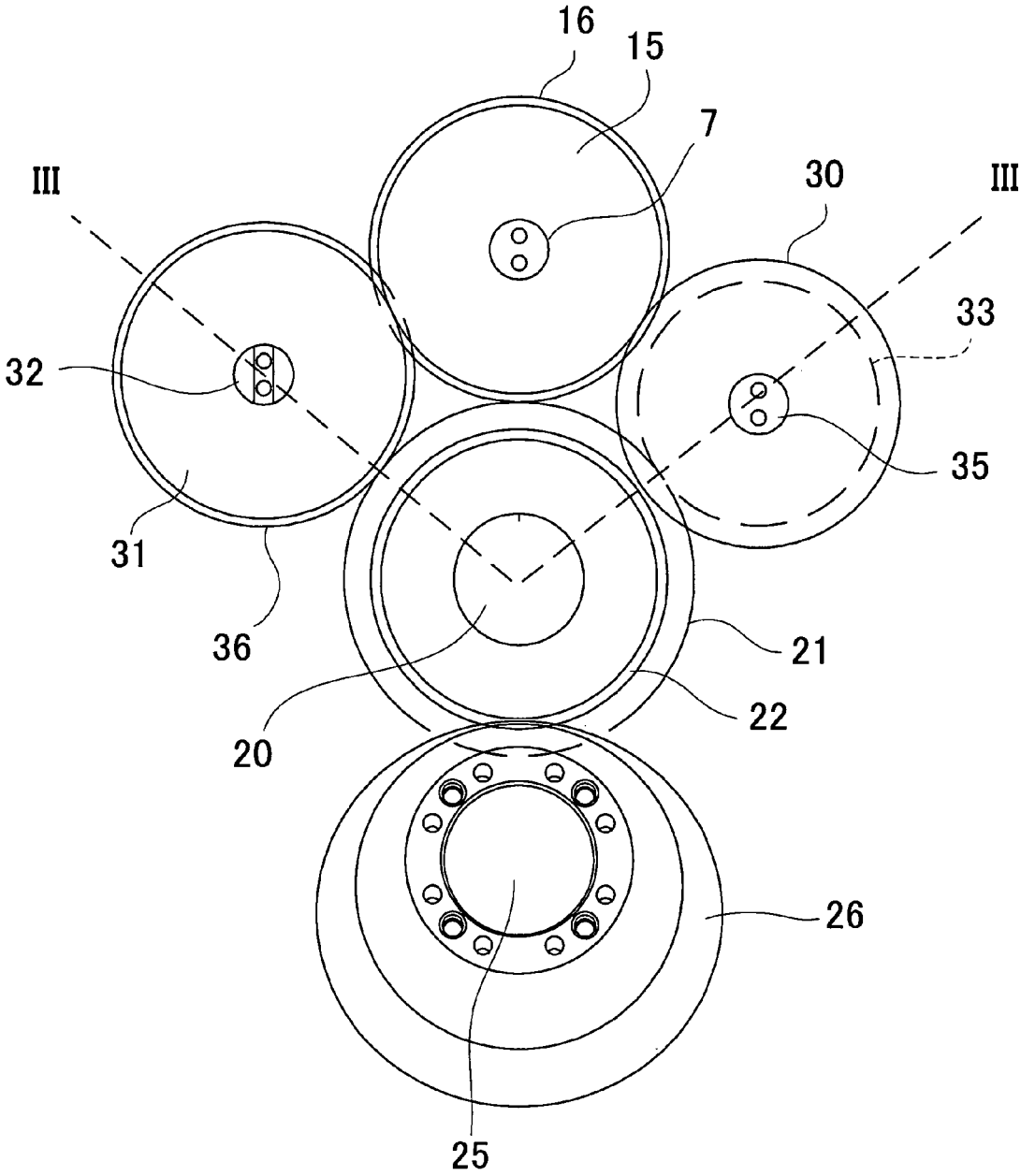
FIG. 2 is a front view illustrating the engagement of gears of the marine reduction and reverse gear unit of FIG. 1.
Figure 3:
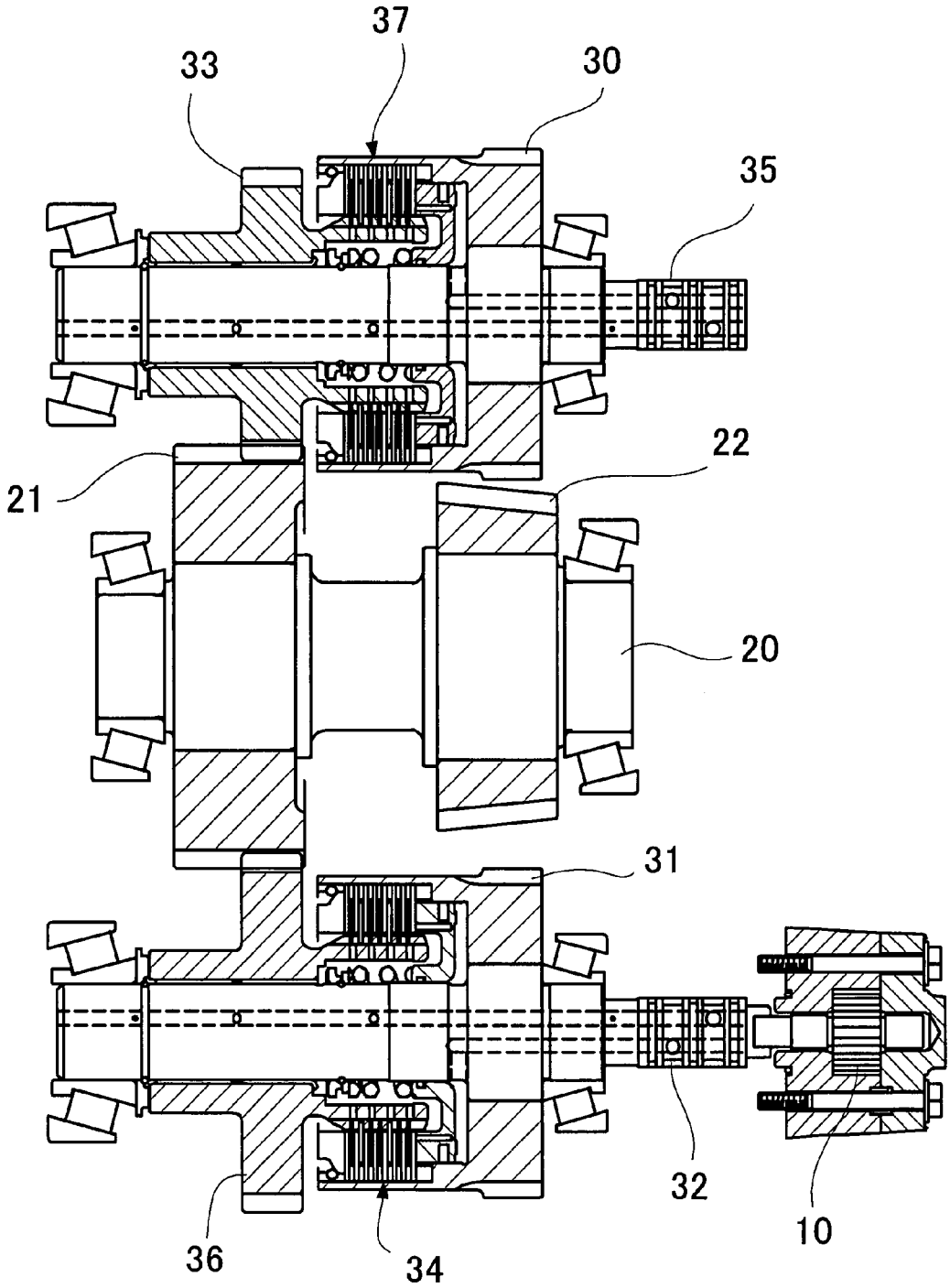
FIG. 3 is a sectional view taken along the line III-III of FIG. 2.
Figure 4:
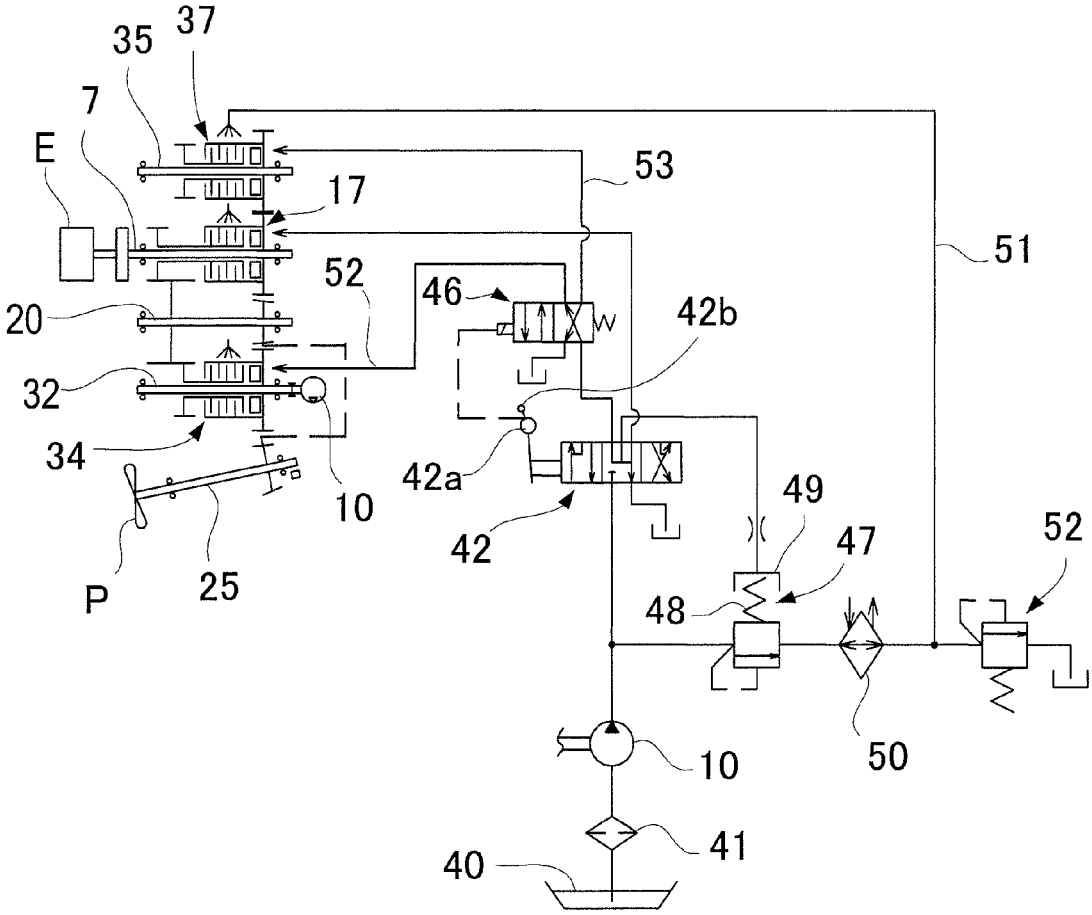
FIG. 4 is a diagram of a first embodiment of a hydraulic circuit provided in the marine reduction and reverse gear of FIG. 1.

First, a first embodiment of a marine reduction and reverse gear unit according to the present invention is described with reference to FIGS. 1 to 4. FIG. 1 is a longitudinal sectional view illustrating the marine reduction and reverse gear unit. FIG. 2 is a front view illustrating the engagement of gears of the marine reduction and reverse gear unit. FIG. 3 is a sectional view taken along the line III-III of FIG. 2. FIG. 4 is a diagram of a hydraulic circuit provided in the marine reduction and reverse gear unit.

The marine reduction and reverse gear unit 1 is provided with a casing 2. The casing 2 is fixed on a housing 5 in which components such as a flywheel 4 connected to a rotary shaft 3 of an engine E (FIG. 4) are accommodated. The flywheel 4 is connected to one end of an input shaft 7 via an elastic coupling 6. The input shaft 7 is rotatably supported by bearings 8, 9 in the casing 2. A cover 5A of the housing 5 may be integrally formed with the casing 2.

A drive gear 15 is fixed on the input shaft 7, and a reverse gear 16 is rotatably supported by the input shaft 7. A reverse hydraulic clutch 17 for connecting the drive gear 15 and reverse gear 16 is also disposed on the input shaft 7 and located between the drive gear 15 and reverse gear 16. The reverse hydraulic clutch 17 is a known wet multiplate clutch. A plurality of clutch discs are fixed on an inner drum integrally formed with the reverse gear 16, and each of a plurality of pressure plates fixed on an outer drum integrally formed with the drive gear 15 are inserted into each space between the plurality of the clutch discs. These discs and plates are brought into tight contact with each other by the pressing force of a hydraulic piston to thereby transmit driving force.

The reverse gear 16 is engaged with a first idle gear 21 fixed on an idle shaft 20. The idle shaft 20 is rotatably supported by a casing 2. A second idle gear 22 is also fixed on the idle shaft 20 and located at a distance from the first idle gear 21 toward the bow of the boat. The second idle gear 22 is engaged with an output gear 26 fixed on an output shaft 25. A propeller P (FIG. 4) is fixed on the output shaft 25. The second idle gear 22 and the output gear 26 are in the form of bevel gears. The output shaft 25 is disposed at an acute angle with respect to the idle shaft 20, and the idle shaft 20 is disposed parallel to the input shaft 7. Thus, the axial direction of the output shaft 25 is at an acute angle with respect to that of the input shaft 7.

A first driven gear 30 and a second driven gear 31 are disposed on the right and left sides of the drive gear 15 in such a manner that the drive gear 15 is sandwiched between the first and second driven gears 30, 31. The first driven gear 30 and the second driven gear 31 are engaged with the drive gear 15.

The first driven gear 30 is fixed on a first support shaft 35. The first support shaft 35 is rotatably supported by the casing 2 and disposed parallel to the input shaft 7. A first forward speed gear 33 engaged with a first idle gear 21 is rotatably supported by the first support shaft 35 and disposed at a distance from the first driven gear 30. A first forward speed hydraulic clutch 37 for connecting the first driven gear 30 and first forward speed gear 33 is also disposed on the first support shaft 35 and located between the first driven gear 30 and the first forward speed gear 33. The first forward speed hydraulic clutch 37 is a wet multiplate clutch as used for the reverse hydraulic clutch 17.

The second driven gear 31 is fixed on a second support shaft 32. The second support shaft 32 is rotatably supported by the casing 2 and disposed parallel to the input shaft 7. A second forward speed gear 36 engaged with a first idle gear 21 is rotatably supported by the second support shaft 32 and disposed at a distance from the second driven gear 31. A second forward speed hydraulic clutch 34 for connecting the second driven gear 31 and second forward speed gear 36 is also disposed on the second support shaft 32 and located between the second driven gear 31 and the second forward speed gear 36. The second forward speed hydraulic clutch 34 is a wet multiplate clutch as used for the reverse hydraulic clutch 17.

By making the diameter of the first forward speed gear 33 smaller than that of the second forward speed gear 36, the speed reducing ratio provided by the first forward speed gear 33 and the first idle gear 21 is made greater than that provided by the second forward speed gear 36 and the first idle gear 21.

The first and second support shafts 35, 32 constantly rotate with respect to the input shaft 7 via the drive gear 15, and the first and second driven gears 30, 31, respectively. According to this embodiment, a gear pump 10 (FIG. 3) driven by the input shaft 7 is provided at the other end of the second support shaft 32. A hydraulic circuit for supplying hydraulic or lubricating oil to hydraulic clutches, etc. by the gear pump 10 is formed in a hydraulic control block 11, and the hydraulic control block 11 is mounted on the casing 2.

The marine reduction and reverse gear 1 having the above configuration transmits driving force from an engine E (see FIG. 4) to an output shaft 25 in the following manner.

In reverse drive, rotation of the input shaft 7 is transmitted to the output shaft 25 via the drive gear 15, reverse hydraulic clutch 17, reverse gear 16, first idle gear 21, second idle gear 22, and output gear 26.

By shifting from reverse drive to first forward speed drive, the reverse hydraulic clutch 17 is disengaged and the first forward speed hydraulic clutch 37 is engaged, so that the rotation of the input shaft 7 is transmitted to the output shaft 25 via the drive gear 15, first driven gear 30, first forward speed gear 33, first idle gear 21, second idle gear 22, and output gear 26 to achieve a high reduction ratio.

By shifting from first forward speed drive to second forward speed drive, the first forward speed hydraulic clutch 37 is disengaged and the second forward speed hydraulic clutch 34 is engaged, so that the rotation of the input shaft 7 is transmitted to the output shaft 25 via the drive gear 15, second driven gear 31, second forward speed gear 36, first idle gear 21, second idle gear 22, and output gear 26 to achieve a low reduction ratio, compared with a high reduction ratio achieved with the first forward speed drive.

A first embodiment of a hydraulic circuit for controlling the reverse hydraulic clutch 17, first forward speed hydraulic clutch 37, and second forward speed hydraulic clutch 34 is described below with reference to FIG. 4.

A gear pump 10 on a second support shaft 32 is driven by rotation of an input shaft 7. The gear pump 10 draws oil from an oil sump 40 in the casing 2 via an oil filter 41, and discharges the oil. The hydraulic oil discharged from the gear pump 10 is supplied to the reverse hydraulic clutch 17 via a forward/reverse directional control valve 42 or supplied to the first forward speed hydraulic clutch 37 or second forward speed hydraulic clutch 34 via a forward/reverse directional control valve 42 and an electromagnetic shift control valve 46.

In the embodiment illustrated, the forward/reverse directional control valve 42 is a manual 5-port, 3-position directional control valve. The forward/reverse directional control valve 42 can be connected to a shift lever 42*a* in the vessel by a wire cable (not shown).

The hydraulic circuit is provided with a relief valve 47 having a soft engagement function to reduce the impact of abrupt engagement by clutches 17, 34, and 37. The relief valve 47 comprises a pressure-control spring 48 and a spring bearing 49 in the form of a hydraulic piston, which is capable of compressing the pressure-control spring 48 and disposed in a cylinder (not shown). The hydraulic circuit includes a pressure control circuit formed by connecting a throttling passage branched from a forward output port and a reverse output port of the forward/reverse directional control valve 42 to an oil chamber in the spring bearing 49. When the forward/reverse directional control valve 42 is in the neutral position (as in FIG. 4), the spring bearing 49 is in the most retracted position due to a biasing force of the pressure-control spring 48, so that the relief valve 47 functions as a relief valve having a low set pressure. When the forward/reverse directional control valve 42 is shifted to forward or reverse, the spring bearing 49 moves to compress the pressure-control spring 48 with a time delay. When the set pressure of the relief valve 47 gradually increases and the spring bearing 49 reaches a specified stroke, the maximum hydraulic pressure for the clutch is obtained. Thus, the hydraulic pressure for the clutch is gradually increased.

The oil passed through the relief valve 47 is cooled with an oil cooler 50, and then passed through a lubricant oil passage 51. The set pressure of the lubricant oil passage 51 is controlled by a relief valve 52.

According to the first embodiment of the hydraulic circuit, the boat is run at a normal speed by shifting the forward/reverse switching valve 42 to the forward or reverse position. During normal-speed running, the electromagnetic shift control valve 46 is not excited and is positioned as shown in FIG. 4 to thereby engage the second speed hydraulic clutch 34. Switch 42*b* connected to the electromagnetic shift control valve 46 is provided on the grip head of the shift lever 42*a*. By shifting a shift lever 42*a*, based on electrical commands, second forward speed is switched to first forward speed. When wakeboarding, where the boat runs with added ballast water to increase the tare weight, the first forward speed hydraulic clutch 37 for high reduction ratios is engaged to increase the number of engine revolutions and make a high torque range available, thereby achieving a stable boat speed and enhanced acceleration performance. When not wakeboarding, where the boat runs at a normal speed, the electromagnetic shift control valve 46 is shifted to disengage the first forward speed hydraulic clutch 37 and engage the second forward speed hydraulic clutch 34, thereby reducing the number of engine revolutions and achieving stable economical running.

Next, a second embodiment of a hydraulic circuit is described below with reference to FIG. 5. The second embodiment of the hydraulic circuit is structurally the same as the above first embodiment except that a pilot-operated spring-return directional control valve, which operates using the primary hydraulic pressure as pilot pressure, is used as the directional control valve 46*a* in place of the electromagnetic directional control valve 46.

Figure 5:
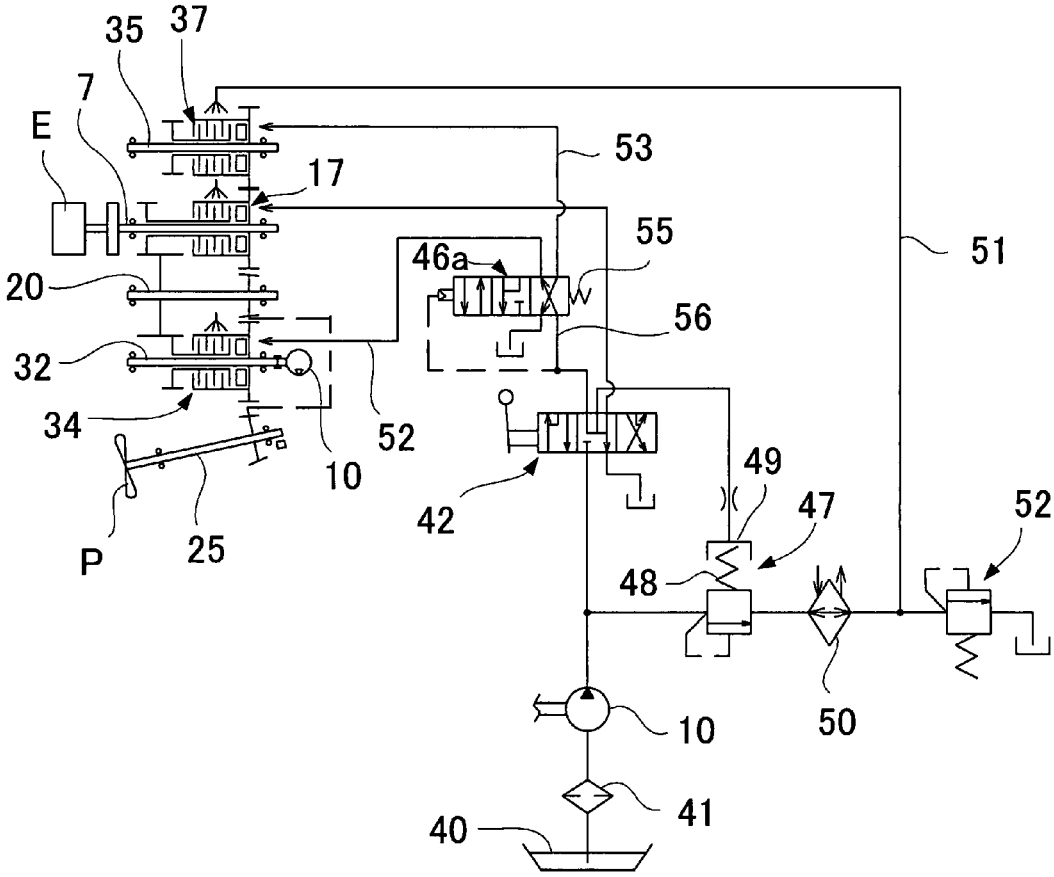
FIG. 5 is a diagram of a second embodiment of a hydraulic circuit that is a modification of the hydraulic circuit of FIG. 4.

The shift control valve 46*a* shown in FIG. 5 is a spring offset valve. When the valve is in the normal position, the valve allows the secondary port to communicate with an oil passage 53 for supplying hydraulic oil to the second forward speed hydraulic clutch 34 for low reduction ratios for normal-speed running, and allows an oil passage 52 for supplying hydraulic oil to the first forward speed hydraulic clutch 37 for high reduction ratios to communicate with a drain.

As the number of rotations of the input shaft 7 increases by increasing the number of engine revolutions, the number of rotations of the gear pump 10 increases, thereby increasing the pilot pressure, i.e., the pressure of oil running through the primary oil passage 56, and shifting the directional control valve 46*a* to the right side of FIG. 5 against the spring force of the offset spring 55. As a result, the shift control valve 46*a* allows the oil passage 52 for supplying hydraulic oil to the second forward speed hydraulic clutch 34 to communicate with a drain, and allows the oil passage 52 for supplying hydraulic oil to the first forward speed hydraulic clutch 37 to communicate with the primary oil passage 56, thereby disengaging the second forward speed hydraulic clutch 34 and engaging the first forward speed hydraulic clutch 37.

Since the hydraulic circuit according to the second embodiment operates in the above-described manner, the following effects can be achieved. When wakeboarding, where the boat runs at a comparatively low speed with added ballast water to increase the tare weight, the number of engine revolutions is increased to automatically engage the first forward speed hydraulic clutch 37 and make a high torque range available, thereby providing a stable boat speed and enhanced acceleration performance. When not wakeboarding, where the boat runs at a normal speed, the number of engine revolutions is reduced to automatically disengage the first forward speed hydraulic clutch 37 and engage the second forward speed hydraulic clutch 34, thereby achieving stable running. Thus the operator is free from the need to perform complicated clutch shift operations, and does not have to be conscious thereof when running the boat.

Next, a third embodiment of a hydraulic circuit is described with reference to FIG. 6. The third embodiment of the hydraulic circuit is a modification of the second embodiment of the hydraulic circuit.

The third embodiment of the hydraulic circuit is the same as the second embodiment in that the shift control valve 46*b* is a pilot-operated spring-return 3-position directional control valve using the primary pressure as pilot pressure.

Figure 6:
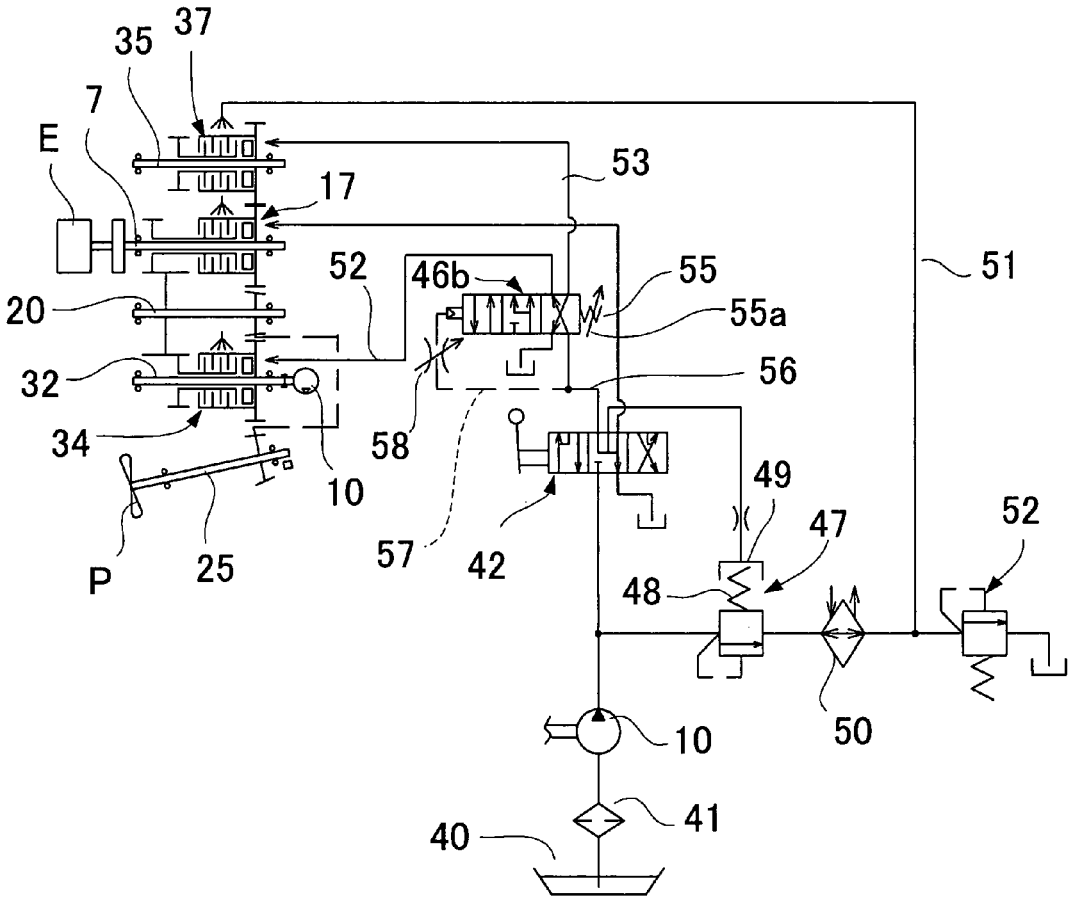
FIG. 6 is a diagram of a third embodiment of a hydraulic circuit that is a modification of the hydraulic circuit of FIG. 5.

However, the shift control valve 46*b* shown in FIG. 6 is structurally different from the valve 46*a* shown in FIG. 5 in that when the shift control valve is in the center position, the secondary port communicates with both of the oil passages to supply hydraulic oil to the first forward speed hydraulic clutch 37 and the second forward speed hydraulic clutch 34.

Other differences from the hydraulic circuit of FIG. 5 are that the pilot oil passage 57 of the shift control valve 46*b* is provided with a variable throttle valve 58, and the return spring 55 of the shift control valve 46*b* is provided with a spring force adjustment mechanism 55*a*.

Figure 7:
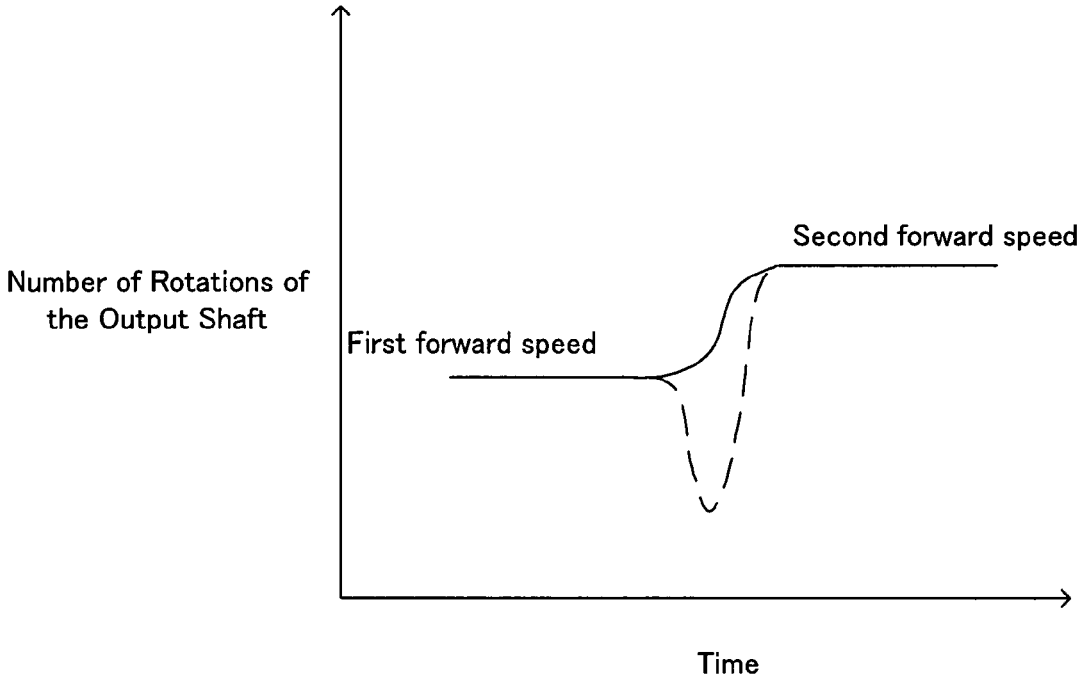
FIG. 7 is a graph showing output characteristics of a marine reduction and reverse gear unit provided with the hydraulic circuit shown in FIG. 6.

According to the third embodiment of the hydraulic circuit having the above configuration, when the shift control valve 46*b* is in the center position at the time of shifting from forward first speed to second forward speed, hydraulic oil is temporarily supplied to both the first forward speed hydraulic clutch 37 and the second forward speed hydraulic clutch 34. As a result, there is no temporal decrease in the number of rotations of the output shaft as indicated by the broken line in the graph of FIG. 7 when shifting from first forward speed to second forward speed, and smooth shifting as indicated by the solid line in the graph of FIG. 7 is achieved partly due to the slip engagement effect of the friction clutch.

In the embodiment illustrated, the pilot oil passage 57 is provided with a variable throttle valve 58, and the return spring 55 is provided with a spring force adjustment mechanism 55*a*. However, since these components are to adjust the timing of shifting between first forward speed and second forward speed, either one of the components may be used. It is also possible to use a variable flow-control valve in place of the variable throttle valve 58.

Next, a second embodiment of a marine reduction and reverse gear according to the present invention is described with reference to FIGS. 8 and 9.

Figure 8:
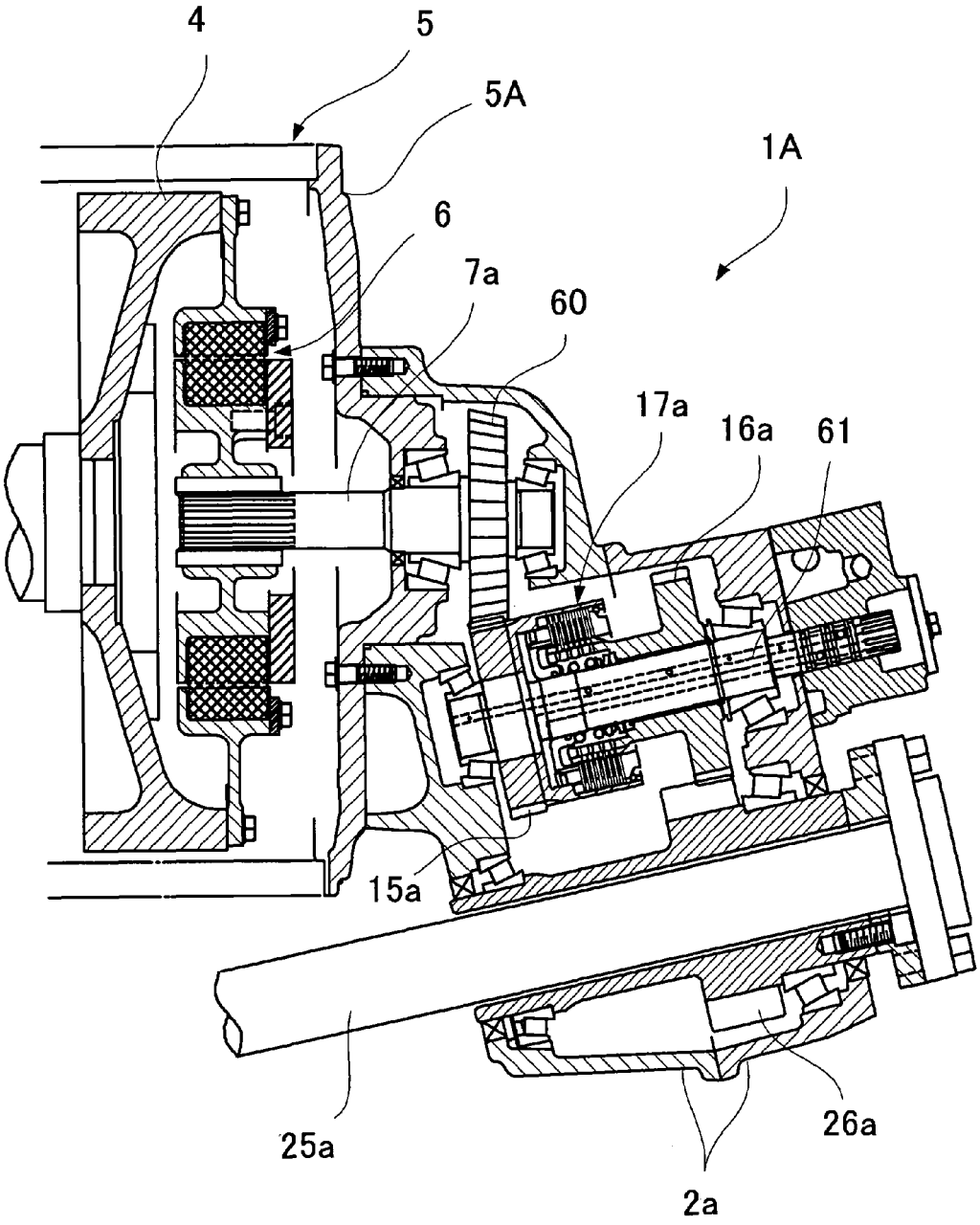
FIG. 8 is a longitudinal sectional view illustrating a second embodiment of a marine reduction and reverse gear unit according to the present invention.
Figure 9:
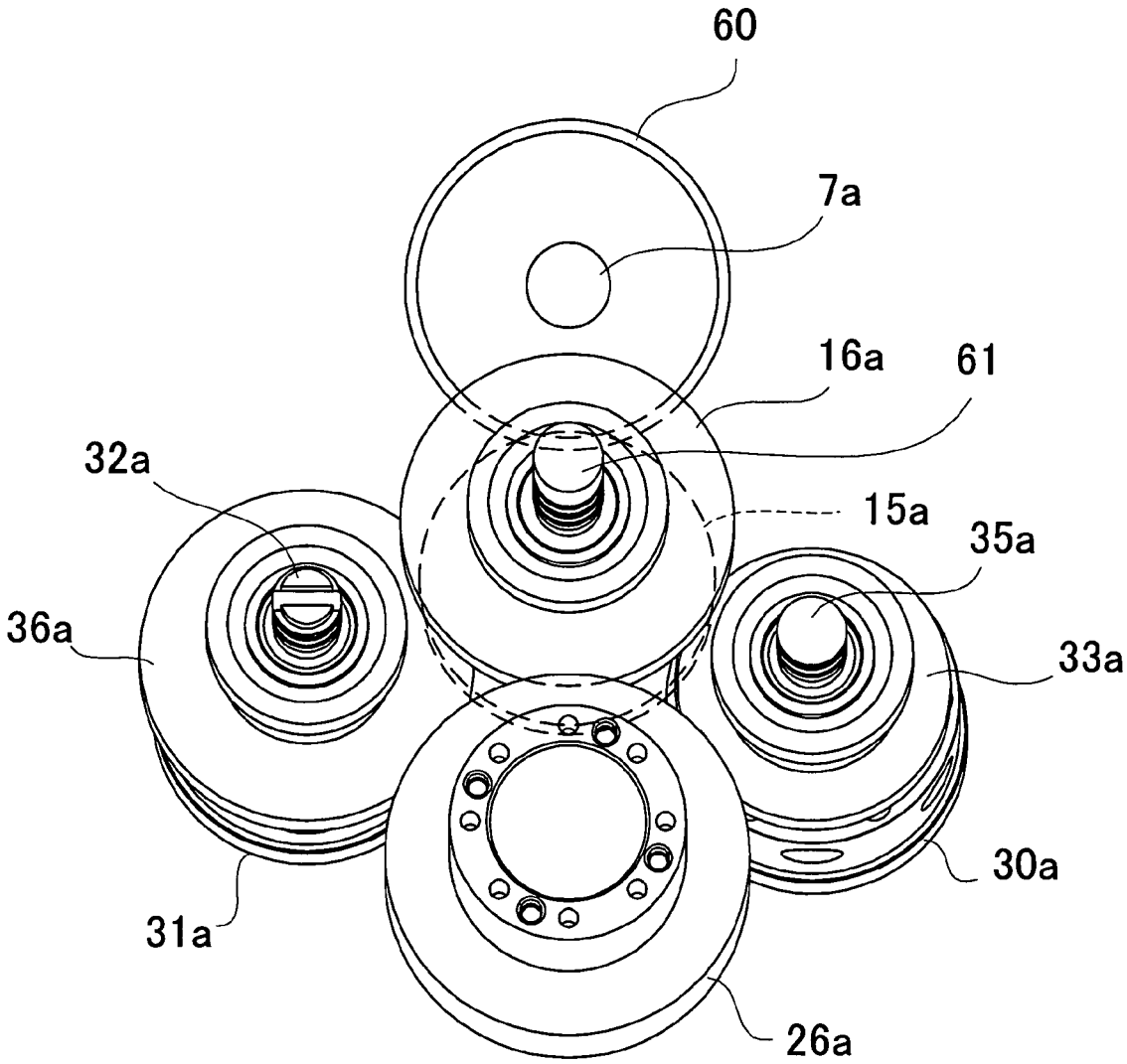
FIG. 9 is a front view illustrating the engagement of gears of the marine reduction and reverse gear unit of FIG. 8.

As shown in FIG. 8, the marine reduction and reverse gear unit 1A according to the second embodiment comprises a bevel gear 60 fixed on an input shaft 7*a* supported by a casing 2*a*. A drive gear 15*a* engaged with the bevel gear 60 is fixed on a third support shaft 61. The third support shaft 61 is supported by the casing 2*a* and disposed at an acute angle with respect to the axis of the input shaft 7*a*. A reverse gear 16*a* is rotatably supported by the third support shaft 61 and disposed at a distance from the drive gear 15*a* toward the bow of the boat. A reverse hydraulic clutch 17*a* for connecting the drive gear 15*a* and reverse gear 16*a* is disposed between the drive gear 15*a* and reverse gear 16*a*. The reverse gear 16*a* is engaged with an output gear 26*a* of an output shaft 25*a*. The output shaft 25*a* is rotatably supported by the casing 2*a* and disposed parallel to the third support shaft 61. Thus, the direction of the output shaft 25*a* is disposed at an acute angle with respect to the input shaft 7*a*.

A first driven gear 30*a* and a second driven gear 31*a* are disposed on the right and left sides of the driven gear 15*a* to sandwich the driven gear 15*a* between the first and second driven gears 30*a*, 31*a*. The first driven gear 30*a* and the second driven gear 31*a* are engaged with the drive gear 15*a*.

The first driven gear 30*a* is fixed on a first support shaft 35*a*. The first support shaft 35*a* is rotatably supported by the casing 2*a* and disposed parallel to the third support shaft 61. A forward first gear 33*a* engaged with an output gear 26*a* is rotatably supported by the first support shaft 35*a* and disposed at a distance from the first driven gear 30*a* toward the bow of the boat. A first forward speed hydraulic clutch (not shown) for connecting the first driven gear 30*a* and the first forward speed gear 33*a* is also disposed on the first support shaft 35*a* and located between the first driven gear 30*a* and the first forward speed gear 33*a*.

The second driven gear 31*a* is fixed on a second support shaft 32*a*. The second support shaft 32*a* is rotatably supported by the casing 2*a* and disposed parallel to the third support shaft 61. A second forward speed gear 36*a* engaged with an output gear 26*a* is rotatably supported by the second support shaft 32*a* and disposed at a distance from the second driven gear 31*a*. A second forward speed hydraulic clutch (not shown) for connecting the second driven gear 31*a* and the second forward speed gear 36*a* is also disposed on the second support shaft 32*a* and located between the second driven gear 31*a* and the second forward speed gear 36*a*.

The input shaft of the marine reduction and reverse gear unit according to the second embodiment is shorter than the input shaft according to the first embodiment. This downsizing can provide more space above the casing 2. The hydraulic circuit may be the same as in the first embodiment.

Figure 10:
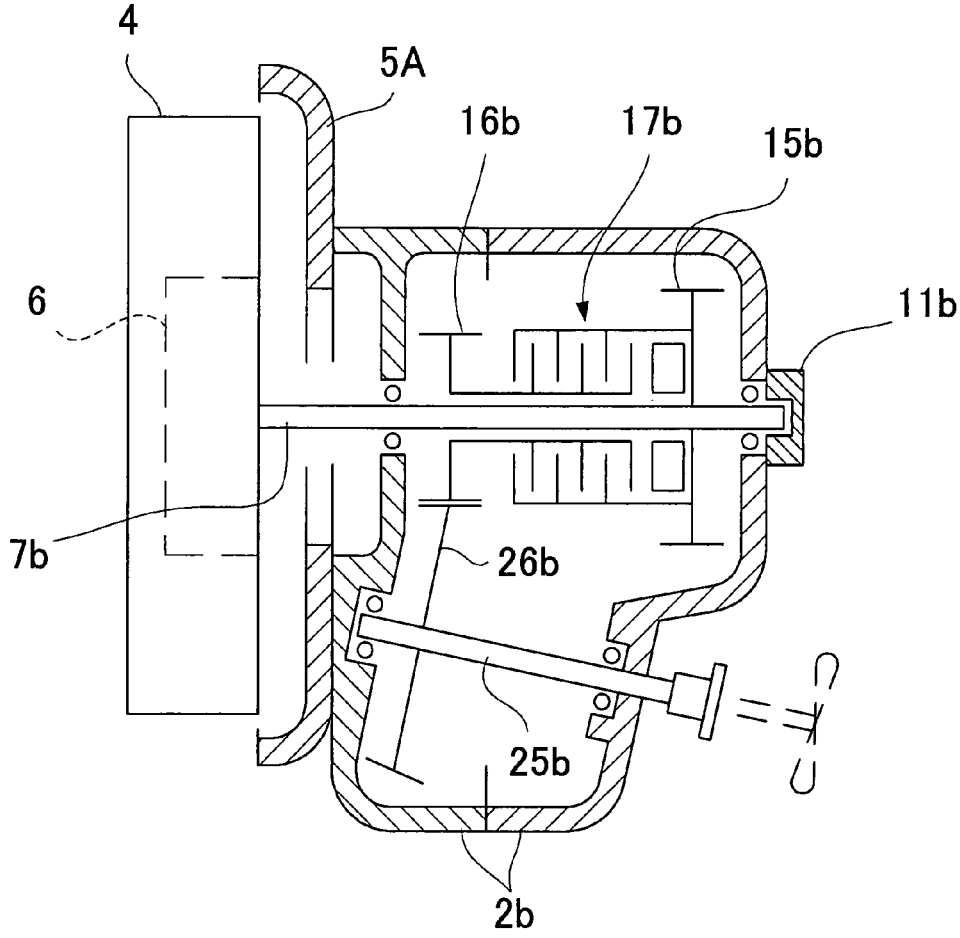
FIG. 10 is a longitudinal sectional view schematically illustrating a third embodiment of a marine reduction and reverse gear unit according to the present invention.
Figure 11:
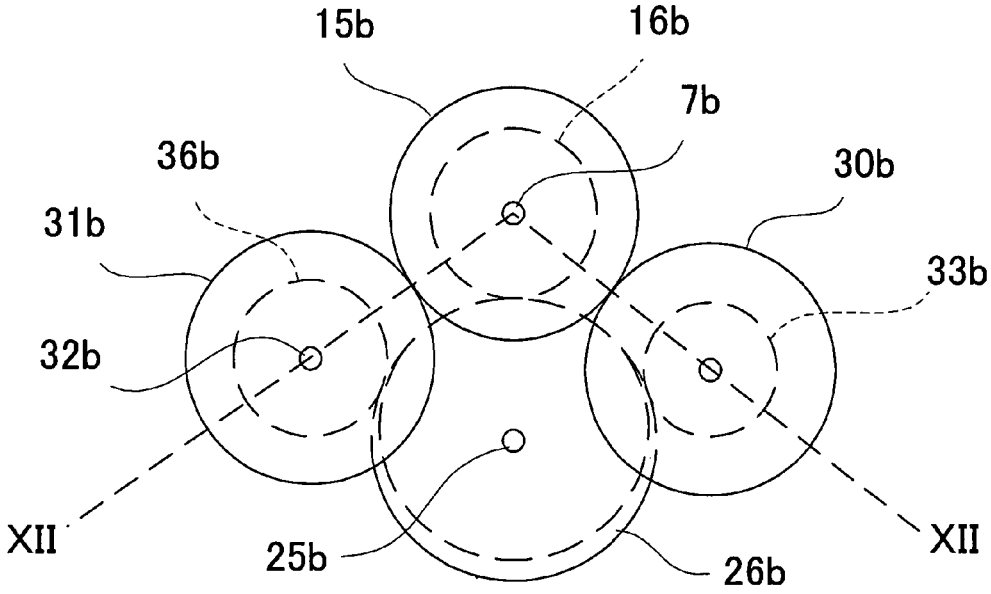
FIG. 11 is a front view illustrating the engagement of gears of the marine reduction and reverse gear unit of FIG. 10.
Figure 12:
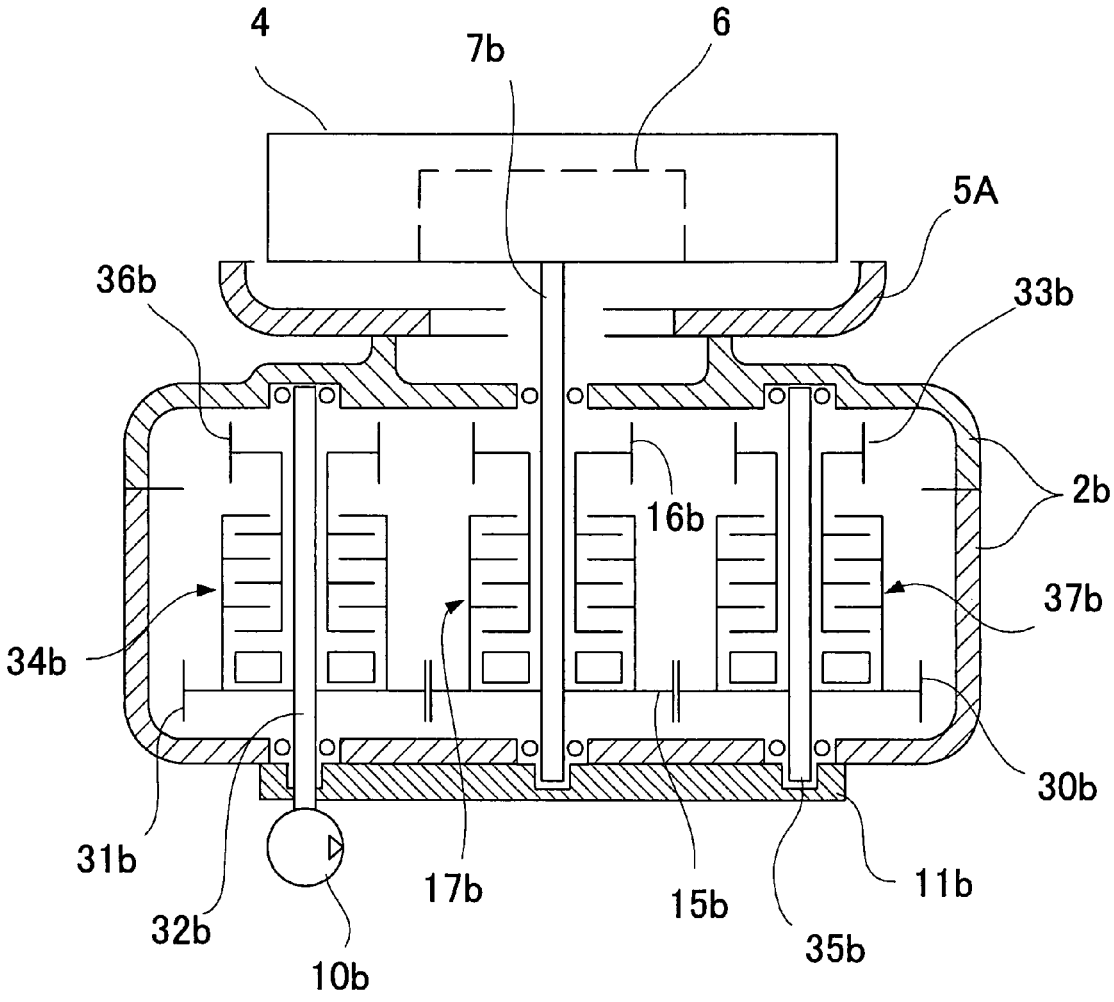
FIG. 12 is a sectional view taken along the line XII-XII of FIG. 11.

Next, a third embodiment of a marine reduction and reverse gear unit according to the present invention is described with reference to FIGS. 10 to 12. The first and second embodiments illustrate V-drive marine reduction and reverse gear units. The third embodiment illustrates an angle-drive marine reduction and reverse gear unit.

The third embodiment is a modification of the first embodiment to an angle-drive marine reduction and reverse gear unit in which the idle shaft is omitted from the first embodiment.

In reverse drive, engine revolution is transmitted to an output shaft 25*b* via the following components: an elastic coupling 6; an input shaft 7*b*; a drive gear 15*b* fixed on an input shaft 7*b*; a reverse hydraulic clutch 17*b*; a reverse gear 16*b* rotatably supported by the input shaft 7*b*; and an output gear 26*b*.

In first forward speed drive, engine revolution is transmitted to the output shaft 25*b* via the following components: the elastic coupling 6; the input shaft 7*b*; the drive gear 15*b* fixed on the input shaft 7*b*; a first driven gear 30*b* fixed on a first support shaft 35*b* and engaged with the driven gear 15*b*; a first forward speed hydraulic clutch 37*b*; a first forward speed gear 33*b*; and the output gear 26*b*.

In second forward speed drive, engine revolution is transmitted to the output shaft 25*b* via the following components: the elastic coupling 6; the input shaft 7*b*; the drive gear 15*b* fixed on the input shaft 7*b*; a second driven gear 31*b* fixed on a second support shaft 32*b* and engaged with the driven gear 15*b*; a second forward speed hydraulic clutch 34*b*; a second forward speed gear 36*b*; and the output gear 26*b*.

Figure 13:
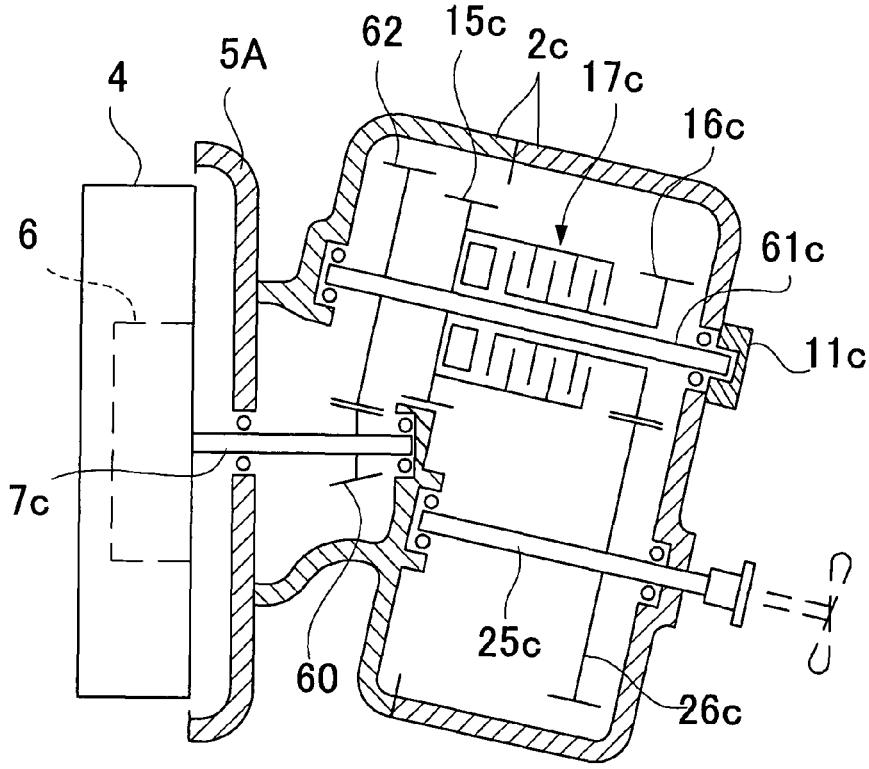
FIG. 13 is a longitudinal sectional view schematically illustrating a fourth embodiment of a marine reduction and reverse gear unit according to the present invention.
Figure 14:
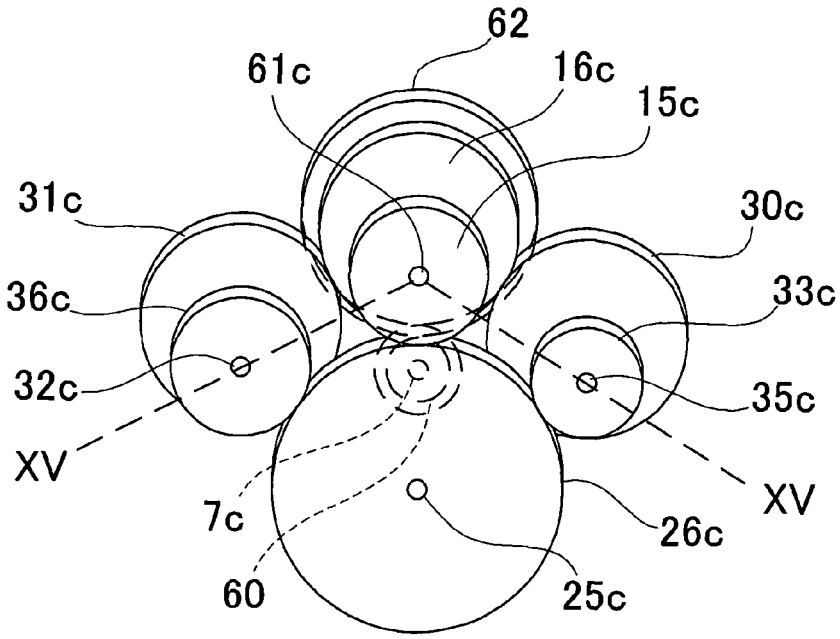
FIG. 14 is a front view illustrating the engagement of gears of the marine reduction and reverse gear unit of FIG. 13.
Figure 15:
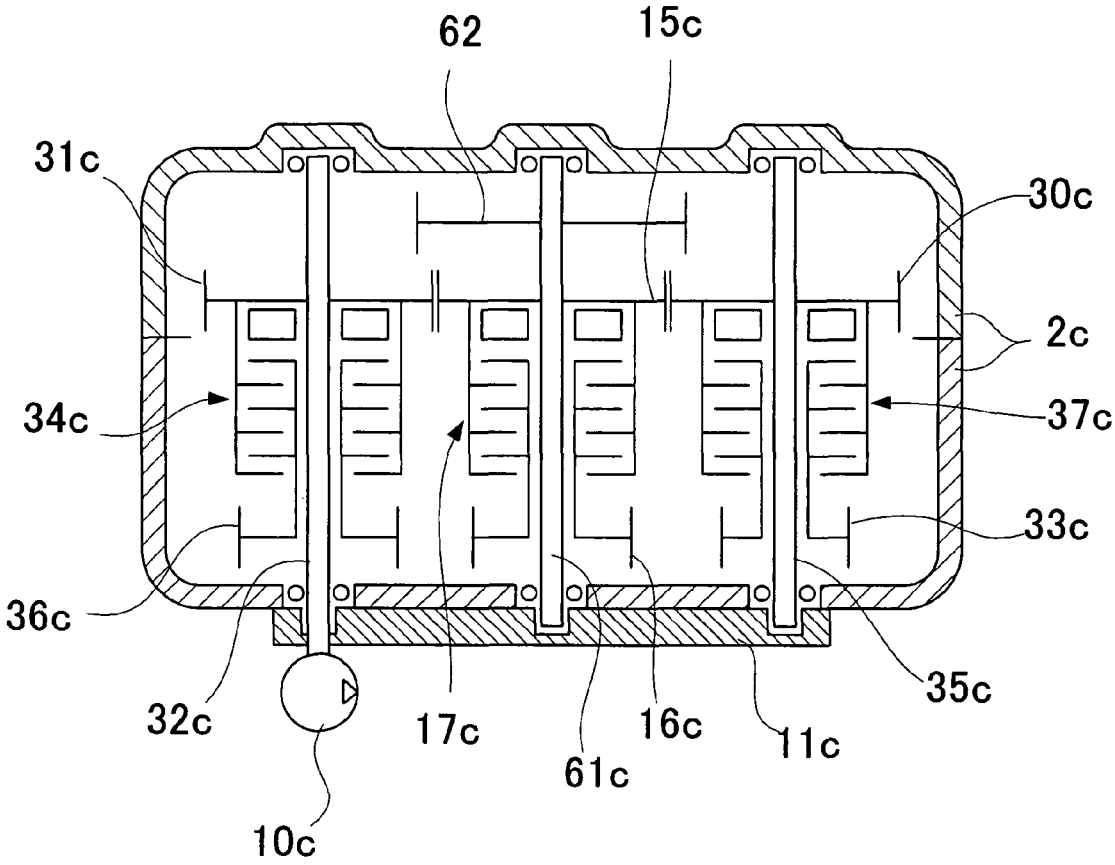
FIG. 15 is a sectional view taken along the line XII-XII of FIG. 14.

Next, a fourth embodiment of a marine reduction and reverse gear unit according to the present invention is described with reference to FIGS. 13 to 15. The fourth embodiment is a modification of the second embodiment to an angle-drive marine reduction and reverse gear unit in which a drive gear 15*c* is not directly engaged with a bevel gear 60 fixed on an input shaft 7*c*, but another gear 62 mounted side-by-side with the drive gear 15*c* on a third support shaft 61*c* is engaged with the bevel gear 60, so that rotation of the input shaft 7*c* is transmitted from the gear 62 to the drive gear 15*c* via the third support shaft 61*c*. More specifically, the gear 62 is integrally connected to the drive gear 15*c*.

In reverse drive, engine revolution is transmitted to an output shaft 25*c* via the following components: an elastic coupling 6; an input shaft 7*c*; a bevel gear 60; a gear 62; a drive gear 15*c*; a reverse hydraulic clutch 17*c*; a reverse gear 16*c*; and an output gear 26.

In first forward speed drive, engine revolution is transmitted to the output shaft 25*c* via the following components: the elastic coupling 6; the input shaft 7*c*; the bevel gear 60; the gear 62; the drive gear 15*c*; a first driven gear 30*c* fixed on a first support shaft 35*c*; a first forward speed hydraulic clutch 37*c*; a first forward speed gear 33*c* supported by the first support shaft 35*c*; and the output gear 26*c*.

In second forward speed drive, engine revolution is transmitted to the output shaft 25*c* via the following components: the elastic coupling 6; the input shaft 7*c*; the bevel gear 60; the gear 62; the drive gear 15*c*; a second driven gear 31*c* fixed on a second support shaft 32*c*; a second forward speed hydraulic clutch 34*c*; a second forward speed gear 36*c* supported by the second support shaft 32*c*; and the output gear 26*c*.

In the fourth embodiment, the gear 62 may be omitted and the drive gear 15*c* may be engaged with the bevel gear 60 as in the second embodiment.

The invention claimed is:

1. A marine reduction and reverse gear unit having an output shaft disposed at an acute or obtuse angle with respect to an input shaft, the gear unit comprising:

a drive gear for transmitting torque from the input shaft;

first and second driven gears engaged with the drive gear and disposed on the right and left sides of the drive gear to sandwich the drive gear therebetween;

a reverse gear connected to the drive gear via a reverse hydraulic clutch;

a first forward speed gear of a first speed reduction ratio connected to the first driven gear via a first forward speed hydraulic clutch;

a second forward speed gear of a second speed reduction ratio connected to the second driven gear via a second forward speed hydraulic clutch; and an output gear fixed on the output shaft and engaged directly with any one of said reverse gear, first forward speed gear and second forward speed gear or engaged therewith via idle gears to thereby receive the transmitted torque.

2. A marine reduction and reverse gear unit according to claim 1 wherein the drive gear is fixed on the input shaft, and the reverse gear is rotatably supported by the input shaft; the first driven gear and the first forward speed gear are supported by a first support shaft; and the second driven gear and the second forward speed gear are supported by a second support shaft.

3. A marine reduction and reverse gear unit according to claim 1 wherein the input shaft has a bevel gear fixed thereon; the drive gear or a gear for transmitting rotation to the drive gear is engaged with the bevel gear to transmit torque from the input shaft to the drive gear; the drive gear and the reverse gear are supported by a third shaft; the first driven gear and the first forward speed gear are supported by a first support shaft; and the second driven gear and the second forward speed gear are supported by a second support shaft.

4. A marine reduction and reverse gear unit according to claim 1 further comprising a hydraulic circuit for controlling hydraulic pressure of the reverse hydraulic clutch, first forward speed hydraulic clutch, and second forward speed hydraulic clutch, the hydraulic circuit comprising a shift control valve for switching oil passages to supply hydraulic oil to the first forward speed hydraulic clutch or to the second forward speed hydraulic clutch, the shift control valve being a pilot-operated spring-return directional control valve using the primary hydraulic pressure as pilot pressure and configured to switch from an oil passage for supplying hydraulic oil to the second forward speed hydraulic clutch to an oil passage for supplying hydraulic oil to the first forward speed hydraulic clutch, based on the increase of hydraulic pressure.

5. A marine reduction and reverse gear unit according to claim 4 wherein the shift control valve is a 3-position directional control valve configured in such a manner that when the valve is in the center position, hydraulic oil is supplied to both of the oil passages for supplying hydraulic oil to the first forward speed hydraulic clutch and the second forward speed hydraulic clutch.

6. A marine reduction and reverse gear unit according to claim 4 wherein the pilot oil passage of the shift control valve is provided with a variable throttle or a variable flow-control valve.

7. A marine reduction and reverse gear unit according to claim 4 wherein the return spring of the shift control valve is provided with a spring force adjustment mechanism.

* * * * *